United States Patent [19]

Graneau et al.

[11] 4,167,370

[45] Sep. 11, 1979

[54] METHOD OF AN APPARATUS FOR SELF-SUSTAINING HIGH VACUUM IN A HIGH VOLTAGE ENVIRONMENT

[75] Inventors: Peter Graneau, Concord; Michael B. Silevitch, Brookline; Elizabeth E. Ames, Bedford, all of Mass.

[73] Assignee: Massachusetts Institute of Technology, Cambridge, Mass.

[21] Appl. No.: 737,876

[22] Filed: Nov. 1, 1976

[51] Int. Cl.[2] ..... F04B 37/00; H01J 17/14; H01J 61/26

[52] U.S. Cl. ..... 417/48; 361/120

[58] Field of Search ..... 417/48, 49; 313/231.5, 313/58, 187; 361/120

[56] References Cited

U.S. PATENT DOCUMENTS

| | | | |
|---|---|---|---|
| 3,087,092 | 4/1963 | Lafferty | 313/187 |
| 3,151,274 | 9/1964 | Snell, Jr. | 315/58 |
| 3,154,718 | 10/1964 | Yorker et al. | 315/58 |
| 3,172,597 | 3/1965 | Guyot | 417/49 |
| 3,230,410 | 1/1966 | Hafkemeyer, Jr. et al. | 361/117 |
| 3,271,619 | 9/1966 | Lafferty | 361/120 |
| 3,320,478 | 5/1967 | Harrison | 313/161 |
| 3,391,303 | 7/1968 | Hall | 313/161 |
| 3,448,337 | 6/1969 | Kawiecki | 361/120 |
| 3,489,336 | 1/1970 | Schonhuber | 417/49 |
| 3,538,382 | 11/1970 | Smith, Jr. | 361/120 |
| 3,588,563 | 6/1971 | Schmidt | 417/48 |
| 3,684,461 | 8/1972 | Singleton | 417/49 |
| 3,746,830 | 7/1973 | Fey et al. | 313/161 |
| 3,796,917 | 3/1974 | Hiller | 417/49 |
| 3,811,070 | 5/1974 | Voshall | 361/120 |
| 3,885,202 | 5/1975 | Baker et al. | 313/231.5 |

FOREIGN PATENT DOCUMENTS

| | | | |
|---|---|---|---|
| 1089112 | 1/1959 | Fed. Rep. of Germany | 417/49 |

*Primary Examiner*—William L. Freeh

*Attorney, Agent, or Firm*—Arthur A. Smith, Jr.; Robert Shaw

[57] ABSTRACT

A method of and apparatus for self-sustaining high vacuum in a high voltage environment. The method and apparatus employ ion pumping; the apparatus can be an integral part of high voltage equipment and acts to maintain a high vacuum condition in such equipment.

8 Claims, 3 Drawing Figures

METHOD OF AN APPARATUS FOR SELF-SUSTAINING HIGH VACUUM IN A HIGH VOLTAGE ENVIRONMENT

The Government has rights in this invention pursuant to Contract No. 670 (Task #1) and IPA-0010 awarded by the National Science Foundation.

The present inventions relate to apparatus adapted to self-sustain a high vacuum in high voltage equipment.

There is a need for devices that can be attached to or be an integral part of high voltage systems such as vacuum insulated high voltage underground power lines, for example, to sustain or maintain the high vacuum needed for proper operation of such lines, which high vacuum degrades in the course of time due to outgassing of materials. Another situation to which the present invention applies is one in which the high voltage equipment is a vacuum lightning arrestor which is usually placed, in an operating system, at an inaccessible location; in use, the vacuum of such an arrester is degraded whenever it carries high electric current due to lightning or switching surges in the system and, in the absence of counteracting measures, becomes inoperative.

Accordingly, it is an object of the present invention to provide a method of and apparatus for self-sustaining or maintaining high vacuum in a high voltage system.

Another object is to provide a device that can be integral to the system wherein such high vacuum is to be sustained and which draws electric operating power from the system.

Still another object is to provide a high voltage, vacuum-type, lightning arrester which has an an integral part provision for maintaining the integrity of the vacuum.

A further object is to maintain high vacuum in a chamber that houses circuit breaker contacts or switching contacts and the associated mechanism for operating the contacts.

Yet another object is to maintain high vacuum in a chamber that houses one or more vacuum fuses.

These and still further objects are discussed hereinafter.

The foregoing objects are achieved in apparatus for self-sustaining a vacuum in the presence of outgassing, gas diffusion through walls and the like, that comprises spaced electrodes to receive an ac voltage to create an electric field in the region around the electrodes and means creating a magnetic field in said region, a component of said magnetic field being orthogonal to a component of said electric field in at least part of said region. In the event of degradation of the vacuum, a glow discharge occurs in said region, that ionizes gas molecules therein. The ionized gas molecules are accelerated by the electric field toward and caused to strike the surface of the electrode then serving as cathode. The impacting ions may be buried in the cathode and/or effect sputtering of said surface material. The chemically active sputtered atoms of the cathode metal then combine and form compounds with the major constituents of air, i.e., oxygen, nitrogen and carbon dioxide. This process is normally called "gettering."

The invention is hereinafter described with reference to the accompanying drawing in which.

The present invention is useful in connection with a large number of different types of high voltage equipment. It is described herein, first with respect to one important form thereof, that form being the high-voltage, high-vacuum type lightning arrester or surge diverter labeled 101A in the system shown at 102A in FIG. 1. Other embodiments of the invention are described hereinafter.

The function of the device 101A is to divert surges on a high voltage conductor 18A of a high voltage power source or system 103, usually 60 Hz, as is well known. To effect its function, any surge current is passed from the conductor 18A to a terminal 7A, thence through an electrode 22A, across a gap 21A to an electrode 23A, to a terminal 8A and then ground g. The electrode 22A comprises a perforated (see holes labeled 24A) hollow cylinder 10A and a disc-shaped tip 1A; the electrode 23A comprises a perforated hollow cylinder 11A and a disc-shaped tip 2A. Both of the electrodes 22A and 23A preferably are made of titanium as later discussed. The electrode tips 1A and 2A have essentially planar electrode surfaces 3A and 4A, respectively, that face each other across the gap 21A. Thus any arc that occurs, in the event of a surge condition is from one flat electrode surface such as, for example, 3A to the other electrode surface 4A.

Figure 1:
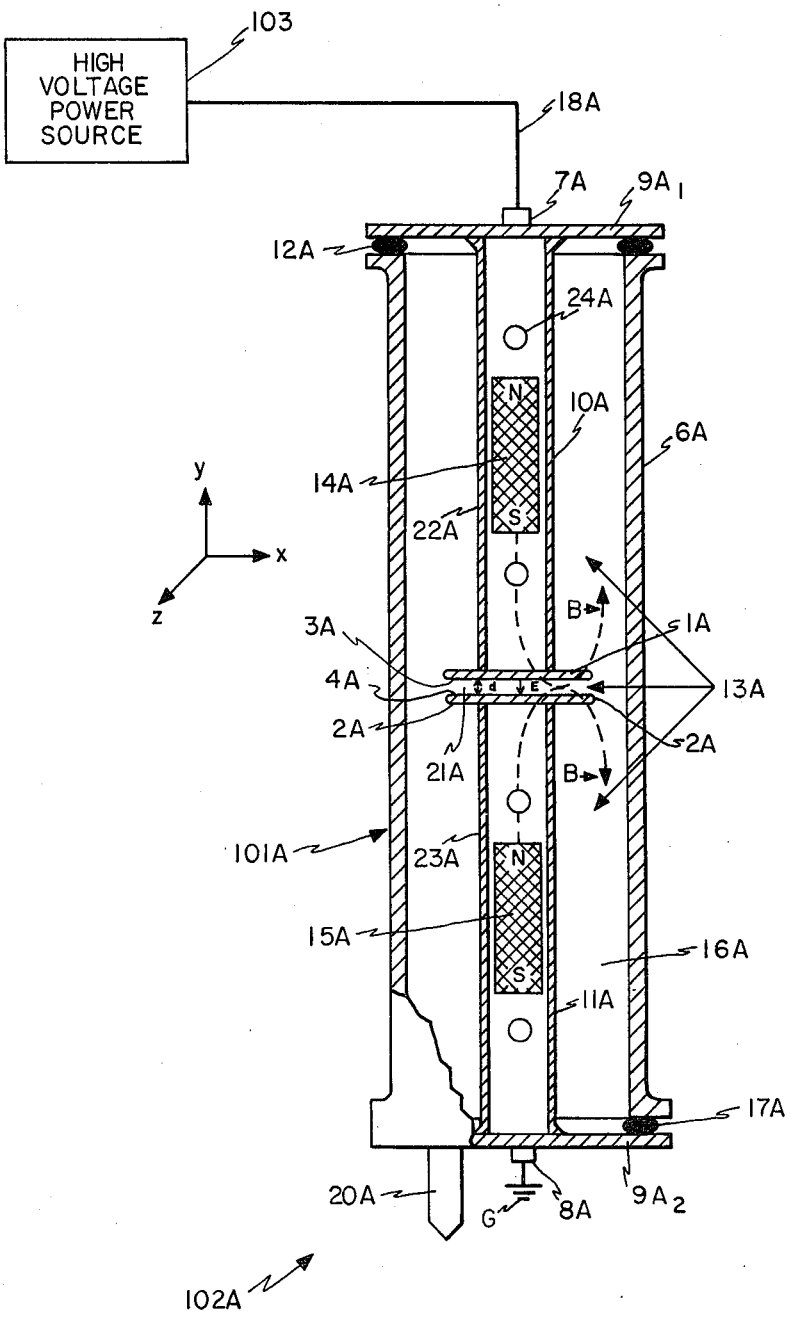
FIG. 1 is a side section view, partly cutaway and partly diagrammatic in form, showing a surge arrester embodying the present invention.

The region labeled 13A in FIG. 1 is of particular importance in the present disclosure because it is in the region 13A that the ion-pumping action of the present invention occurs. More specifically, the region 13A includes the gap 21A as well as the annular space that surrounds both the cylinder members 10A and 11A. In the region 13A there is an ac electric field that is designated E and is most intense within the gap 21A but also appears in said annular space about the cylinders 10A and 11A.

A dc magnetic field designated B is created in the region 13A by a permanent magnet 14A, disposed within the cylinder 10A, and a permanent magnet 15A, disposed within the cylinder 11A. The particular geometry of the various elements in FIG. 1 is chosen such that in at least a part of the region 13A, a component of the dc magnetic field B is orthogonal to a component to the ac electric field E to establish an ac glow discharge that serves to ionize any molecules present in the region 13A. The region 13A is a portion of a larger space 16A which is in fact the vacuum interior of the arrester 101A which further includes a housing 6A comprising ceramic material cylindrical walls 6A, metal caps $9A_1$ and $9A_2$ and indium gaskets 12A and 17A. The whole of the interior space 16A of the arrestor 101A is originally evacuated and then sealed by use of a pinch off tube 20A, and it is the function of the invention herein described to self-sustain that vacuum whenever it is degraded. As discussed below, when such degradation occurs, gas molecules which appear in the space 13A are ionized and accelerated by the electric field and are caused to strike the electrode surfaces of the electrodes 22A and 23A. Some of the ionized gas molecules that strike a particular electrode surface serve to effect sputtering which spreads the material of the electrode surface into the region 13A to effect gettering. The term "electrode surface" or variations thereof, as used herein, denotes the outer walls of the cylinders 10A and 11A as well as the surfaces of the disc-shaped tips 1A and 2A.

In an operating system 102A, the source of high voltage 103 may be typically a 115kV, 230kV or 345kV ac power lines (i.e., high voltage) or even an ultra-high voltage line above 345kV. Magnetic fields of the order of 250 gauss are created in the region 13A by the permanent magnets 14A and 15A, and electric fields of the order of $6\times10^6$ volts r.m.s. per meter (based on an operating phase voltage of 80kV r.m.s. and a one-half inch gap).

The function of the arrester 101A, as noted above, is to bypass any surge voltage that may appear at the terminal 7A to ground G in an operating system. The housing 6A is adapted to maintain the integrity of the vacuum in the space 16A and including the region 13A. In the event of an arc to ground across the gap between the electrode surfaces 3A and 4A, degradation of the vacuum will occur in the region 13A due to gases evolved from internal parts of the device 101A. It is the function of the apparatus herein described to return the condition of vacuum back to where it was before the arc and resulting degradation, i.e., to self-sustain the vacuum. This is done, as above indicated and as later discussed in greater detail, by sweeping (i.e., high voltage ac pumping) any molecules in the region 13A to one or the other electrode surface of the electrodes 22A and 23A. For this reason, the arrestor or surge divertor 101A can be placed at a remote location and left there to function, as required, for years. Typically the high vacuum in the space 16A (and thus, the region 13A) is maintained at a pressure of less than $10^{-5}$ torr. In the apparatus made and tested, the electrodes 22A and 23A, that is both the disc-shaped plates 1A and 2A and the cylindrical members 10A and 11A (in fact, the electrodes 22A and 23A can each be formed from a single piece of metal), are made of titanium to provide gettering. The device 101A may or may not be used in series with an external non-linear resistance to limit the short circuit current supplied by the high voltage power system.

The pumping effect above mentioned is produced by the following mechanism. During each half cycle of the ac voltage waveform a trapped cloud (or plasma) of electrons is created about one of the titanium cylinders (i.e. 10A and 11A). The plasma is concentrated in a "doughnut-like" shape about the center of the magnet contained in the cylinder. On the next half cycle the opposite cylinder has the electron plasma about it. The electrons are forced to orbit about a cylinder because of the $\vec{E}\times\vec{B}$ (crossed field) effect (which essentially means that the electric and magnetic forces on an electron in the region of the cloud cause electrons to orbit about the cylinder). The electron plasma is the essential mechanism which causes neutral atoms (i.e. contaminants of the vacuum) to be pumped away. There are three basic processes involved:

(i) An orbiting electron collides with a neutral atom and ionizes it. The massive positive ion then is attracted to the instantaneous cathode. The ion strikes the electrode and buries itself in the metal (thus becoming a "pumped" ion). This process is especially useful for the noble gases (i.e., He and Ar).

(ii) When a positive ion strikes an electrode, a titanium atom may be sputtered from it. These atoms tend to spread themselves around the vacuum system. Titanium atoms have the property of chemically combining with nitrogen and oxygen atoms present in a vacuum system (i.e., getter effect). Thus the sputtered titanium pumps away the main constituents of air.

(iii) Burial of gas on surfaces by sputtered Ti atoms landing on the gas.

Points (i), (ii) and (iii) above are also the basic mechanisms for a standard sputter ion pump. The high voltage ac pumping effect of the present invention differs from the standard ion pump in the following ways.

(1) High voltage ac (~80kV) is used while conventional pumps use low voltage dc (~5kV).

(2) The high voltage ac is assumed to be inherently available inside the piece of high voltage vacuum insulated apparatus, while conventional ion pumps must have an external power supply. Clearly in the field or in an underground installation one has no way of plugging in the box of electronics which comprises the power supply. Thus, the developed vacuum is self-sustaining.

Figure 2:
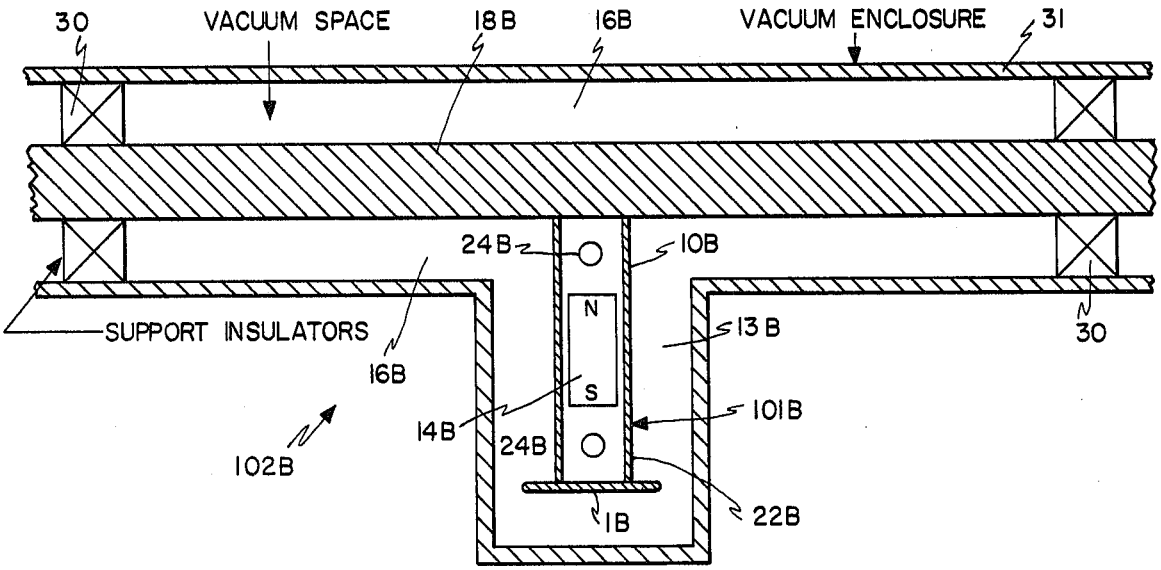
FIG. 2 is a side section view of a portion of a high voltage power line cable that includes the invention as a part thereof.

As above mentioned, the concepts herein disclosed have use in connection with other types of devices than the arrester or diverter 101A. Thus there is shown in FIG. 2 a portion of a high voltage transmission line 102B that has associated with it a device 101B for self-sustaining a vacuum within the vacuum space designated 16B of the line 102B. The device 101B comprises a hollow cylinder 10B that forms an electrode 22B electrically connected to the conductor shown at 18B of the line 102B. That portion of the vacuum space 16B that is the active ion-pumping region is marked 13B. The space 13B is annular, as before, and contains an electric field and a magnetic field, each of which performs in the manner discussed above. Sputtering occurs on the outer surface of the cylindrical electrode 22B. Holes 24B in the cylinder 10B assure equalized pressure within and without the cylinder. The electrode 22B may have a cap 1B. The high voltage power line cable 102B further includes an outer vacuum enclosure 31 and support insulators 30. As above indicated, the ion-pumping action according to the present teaching, occurs mostly in the annular space 13B about the cylindrical member 10B.

Figure 3:
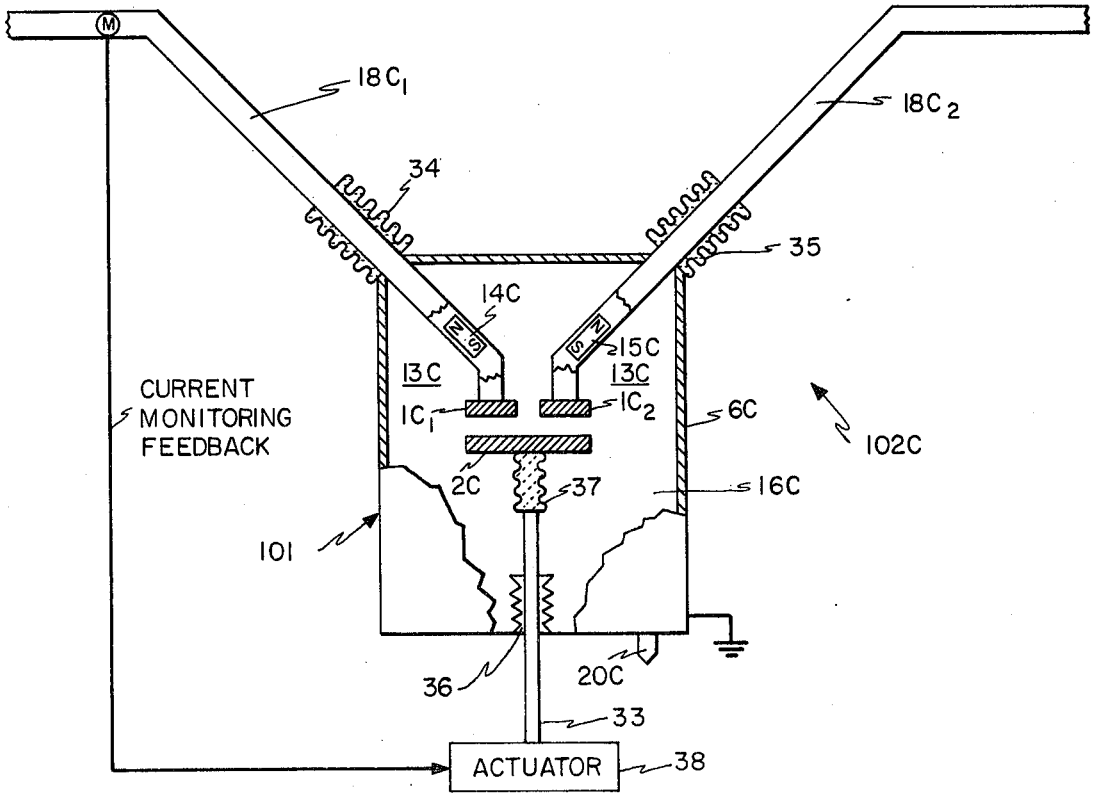
FIG. 3 is a side section view, partly cutaway and partly diagrammatic in form, showing a dead tank vacuum circuit breaker that includes the invention as a part thereof.

Another application is shown diagramatically at 102C in FIG. 3. It illustrates a dead (metal) tank (i.e., the grounded potential tank labeled 6C) high voltage circuit breaker 101C with a self-sustained vacuum pump installed in the high voltage line. Normal circuit breakers are not installed in a dead tank, i.e., they are air insulated and thus must be located well away from any obstacles (i.e., humans). Electric fields necessary for the self-pumping action are generated by high voltage wires $18C_1$ and $18C_2$ and the grounded dead tank 6C. Electric current passes from the conductor 18C, to the conductor $18C_2$ through breaker contacts $1C_1$, 2C and $1C_2$ when the contact 2C is moved up by an actuating pushrod 33 (moved by an activator 38) to effect electrical contact with the contacts $1C_1$ and $1C_2$. Ion pumping, as above discussed, occurs in the region designated 13C within which there is found a dc magnetic field provided by permanent magnets 14C and 15C and a low frequency ac electric field (e.g., 60 Hz) that originates with the conductors $18C_1$ and $18C_2$ and the tank 6C. The ion-pumping action occurs in and around that portion of the apparatus 101C in the vicinity of the magnets 14C and 15C and between the magnets and the electrodes $1C_1$ and $1C_2$, respectively, and that is the region denoted 13C herein. To complete the explanation as to FIG. 3, the conductors $18C_1$ and $18C_2$ enter the tank 6C through bushings 34 and 35, respectively, the pushrod 33 passes through a bellows 36, and the pushrod is isolated from the contact 2C by a bushing 37. A pinch-off tube 20C serves the same purpose on the tube 20A in FIG. 1.

Further modifications of the invention herein disclosed will occur to persons skilled in the art and all such modifications as deemed to be within the spirit and scope of the invention as defined by the appended claims.

What is claimed is:

1. In combination with a device powered by a high voltage having a predetermined pulsating frequency and electrodes spaced by a gap within which an electric field may be established, an enclosure, and means sealing the enclosure in enclosing relation to the powered device for operation thereof under vacuum conditions, the improvement residing in vacuum-sustaining means for preventing degradation of the vacuum conditions in the enclosure, including means connecting the powered device to the electrodes for generating said electric field at said pulsating frequency to form an electron plasma, and magnetic means establishing a magnetic field in said gap for concentrating the electron plasma in the region of the electrodes, whereby a resulting ion-pumping effect maintains the vacuum conditions in the enclosure, said magnetic means comprising at least one permanent magnet enclosed within one of the electrodes adjacent to the gap.

2. Apparatus as claimed in claim 1 wherein at least some of the of the electrodes surfaces are titanium.

3. Apparatus as claimed in claim 1 wherein said plasma is an ac glow discharge comprising ionized gas molecules in the region around the electrodes, which gas molecules are accelerated by the electric field created by the ac potential difference and caused to strike the surfaces of the electrodes, some of the gas molecules that strike the surfaces being buried therein an effecting sputtering that spreads the electrode material into said region to effect gettering.

4. Apparatus that comprises in combination a high voltage source, a vacuum-insulated ac electrical power device connected thereto, and means for generating a plasma in response to ac potential differences inherently established in the high voltage device, said means for generating the plasma comprising metallic electrode surfaces connected to the high voltage source, and a permanent magnet to concentrate the plasma in the region of said surfaces, said plasma producing an ion-pumping effect in conjunction with the metallic surfaces to sustain a vacuum within said device, said electrical power device being a lightning arrester comprising a plurality of electrodes disposed within the vacuum that is self-sustained by the ion-pumping effect of said plasma generated by the ac potential differences and contacts spaced from one another across a vacuum gap, at least one permanent magnet being disposed within at least one electrode of said plurality of electrodes, said at least one electrode serving to house said at least one magnet and serving, as well, as at least part of one of said metallic surfaces.

5. Apparatus as claimed in claim 4 having two electrodes with a permanent magnet in each electrode, each electrode serving to house the associated magnet and serving, as well, as at least part of said metallic surfaces.

6. Apparatus as claimed in claim 5 wherein said electrodes are coaxial as to one another, in which the gap is an axial gap, and in which said plasma is an ac glow discharge comprising ionized gas molecules in the region around the coaxial electrodes, which ionized gas molecules are accelerated by the electric field created by said ac potential differences and caused to strike the electrode surfaces, some of the gas molecules that strike the surfaces being buried therein and effecting sputtering that spreads the electrode material into said region to effect gettering.

7. Apparatus as claimed in claim 6 wherein said electrodes are titanium electrodes.

8. Apparatus that comprises, in combination: a high voltage ac source, a vacuum-insulated ac electrical power device connected thereto having a vacuum established therein, and means for generating a plasma in response to a glow discharge produced by ac potential differences inherently established in the high voltage device by said ac source, said means for generating the plasma comprising metallic electrode surfaces connected to the high voltage source and means concentrating a magnetic field about said electrode surfaces, said plasma producing an ion-pumping effect in conjunction with the metallic surfaces to sustain the vacuum within said device, said means for generating a plasma including a perment magnet, said electrical power apparatus being a vacuum insulated line which includes a hollow metallic electrode connected to the electrical conductor and disposed within the same vacuum space as said conductor, the permanent magnet being disposed within the hollow electrode, the vacuum space about the electrode constituting an active ion pumping region within said plasma which appears in said region and which is in the form of an ac glow discharge comprising ionized gas molecules in the region around the electrode, ionization being effected by the electric field in said region that occurs by virtue of said electric potential difference, said ion pump serving to self-sustain the vacuum within the transmission line.

* * * * *